US005124757A

United States Patent [19]

Ikegawa

[11] Patent Number: 5,124,757

[45] Date of Patent: Jun. 23, 1992

[54] IMAGE FORMING METHOD AND APPARATUS INCLUDING TREATMENT AND COLLECTION OF RESIDUAL DEVELOPER

[75] Inventor: Akihito Ikegawa, Sakai, Japan

[73] Assignee: Minolta Camera Kabushiki Kaisha, Osaka, Japan

[21] Appl. No.: 719,469

[22] Filed: Jun. 24, 1991

[30] Foreign Application Priority Data

Jun. 25, 1990 [JP] Japan ..... 2-168075
Jun. 25, 1990 [JP] Japan ..... 2-168076

[51] Int. Cl.[5] ..... G03G 21/00

[52] U.S. Cl. ..... 355/296; 118/652; 355/298; 355/303

[58] Field of Search ..... 355/269, 270, 296, 298, 355/301-303, 219, 297; 118/652; 430/125

[56] References Cited

U.S. PATENT DOCUMENTS 3,728,016 4/1973 Harbour, Jr. et al. ..... 355/303 X
4,469,435 9/1984 Nosaki et al. ..... 355/303
4,763,168 8/1988 Lindblad ..... 355/303

FOREIGN PATENT DOCUMENTS 53-85142 6/1978 Japan .
56-143477 11/1981 Japan .
59-86080 5/1984 Japan .
61-42669 3/1986 Japan .
62-168174 7/1987 Japan .

*Primary Examiner*—A. T. Grimley
*Assistant Examiner*—William J. Royer
*Attorney, Agent, or Firm*—Burns, Doane, Swecker & Mathis

[57] ABSTRACT

In an apparatus and a method for image forming, in which an electrostatic latent image is formed on a surface of a photoreceptor and the latent image is developed and transferred to a transfer member, developer which remains on the surface of the photoreceptor after the transfer is collected to a cleaning device or an electrical charger when an image forming operation is performed, and is returned to a developing device through the photoreceptor when the image forming operation is not performed.

6 Claims, 4 Drawing Sheets

IMAGE FORMING METHOD AND APPARATUS INCLUDING TREATMENT AND COLLECTION OF RESIDUAL DEVELOPER

BACKGROUND OF THE INVENTION

1. Field of the Invention

The present invention relates to an image forming apparatus such as an electrophotographic copying machine and a laser printer, and to an image forming method.

2. Description of the Related Art

Image forming apparatuses such as electrophotographic copying machines and printers form images in a following manner.

Charging means charges a photoreceptor such as a photosensitive drum to have a uniform potential at a surface thereof, an image exposure corresponding to an image to be copied or printed is applied to the photoreceptor, and then the electrostatic latent image formed on the photoreceptor is developed by a developing device into a visible image, which is transferred to a recording medium and is fixed thereto.

In this processing, developer on the photoreceptor is not fully transferred to the recording medium, and a transfer efficiency is usually about 80–90%, which means that about 10–20% of the developer is not transferred and remains thereon. This residual developer is generally removed by a cleaning device.

There have been cleaning devices of several types such as web sliding type, fur brush type, roller type and blade type.

However, the prior art cleaning devices have following disadvantages.

(1) If the apparatus is designed to discard the removed developer, there is a great loss of the developer, and if it is designed to reuse the developer, means such a recycle tube for returning it to the developing device is additionally required.

(2) In either case that the developer is discarded or returned to the developing device, a container for temporarily collecting the removed developer and a space for mounting it are required, which increases sizes of the image forming apparatus.

(3) In order to avoid increase of the sizes of the image forming apparatus or the cleaning device of a discard type, if used, in the image forming apparatus, the sizes of the collecting container may be reduced. However, the small container may cause overflow of the developer, particularly when images consuming a small amount of developer are formed, i.e., when black or colored areas of the visible images formed by the developer are small, and thus a quantity of residual developer is large.

SUMMARY OF THE INVENTION

Accordingly, it is an object of the invention to provide an image forming apparatus and an image forming method, in which an electrostatic latent image is formed on a photoreceptor and is developed into a visible image to be transferred to a transferring member, and particularly to provide image forming, in which the residual developer on the photoreceptor can be removed to an extent which does not substantially cause any inconvenience in practice, and the removed residual developer can be reused, while a conventional container for temporarily collecting the residual developer is not required, whereby sizes of a whole image forming apparatus, or a cleaning device and parts associated thereto can be reduced, but the residual developer can be collected without any possibility of dropping and dispersing.

Further, it is another object of the invention to provide an apparatus and a method for image forming, in which an electrostatic latent image is formed on a photoreceptor and is transferred to a transferring member, and particularly to provide an apparatus and a method for image forming, in which a conventional cleaning device can be eliminated for overcoming the problems in the prior art caused by the cleaning device, while the residual developer on the photoreceptor can be removed to an extent which does not substantially cause any inconvenience in practice, According to the invention, there is provided an image forming apparatus comprising:

a rotatable photoreceptor;

means for forming an electrostatic latent image on a surface of the photoreceptor;

a developing device for developing with toner the electrostatic latent image on the photoreceptor surface to form a visible image;

means for transferring the visible image onto a recording medium;

means for collecting residual toner remaining on the photoreceptor surface after the transfer;

means for applying a bias voltage to the collecting means; and means for controlling the bias voltage applying means so that the residual toner may be collected and held by the collecting means when image forming is carried out and that the residual toner held by the collecting means is returned to the developing device through the photoreceptor when the image forming is not carried out.

The collecting means may include a cleaner for cleaning the residual toner on the photoreceptor surface after the transfer of the visible image.

The collecting means may include a charging member for charging the photoreceptor surface during the image forming.

Other objects and advantages of the present invention will become more apparent from the following detailed description, when taken into conjunction with the accompanying drawings which show, for the purpose of illustration only, embodiments in accordance with the present invention.

DETAILED DESCRIPTION OF THE PREFERRED EMBODIMENTS

Then, an example will be described with reference to FIGS. 1-3.

Figure 1:
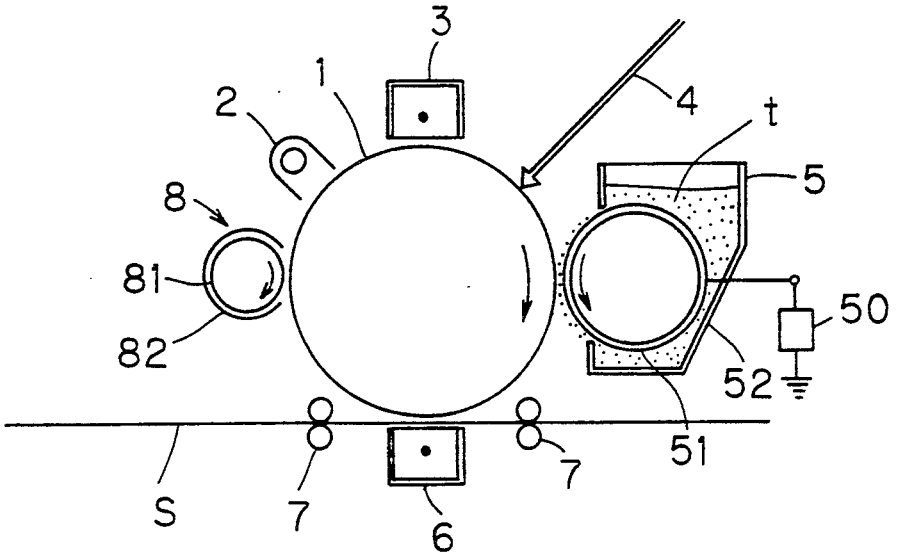
FIG. 1 is a schematic view of a printer according to an embodiment of the invention.
Figure 2:
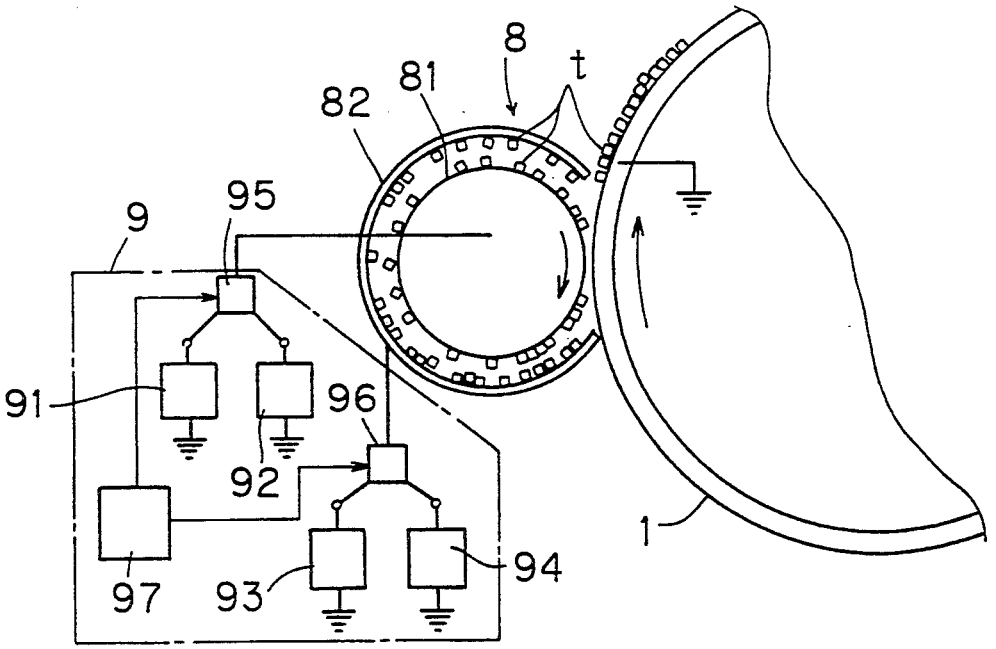
FIG. 2 is an enlarged view of a cleaning device of a printer in FIG. 1.

FIG. 1 is a schematic view of a printer according to an embodiment of the invention. This printer is provided at its central portion with a photosensitive drum 1 to be driven in a clockwise direction in the Figure. Around the drum 1, there are circumferentially disposed an eraser 2, an electrical charger 3, a developing device 5, a transfer charger 6 and a cleaning device 8.

The developing device 5 includes a developing sleeve 51 which is driven in a counterclockwise direction in the Figure and operates to move toner t accommodated in a casing 52 to a developing region.

The cleaning device 8 includes a cleaning roller 81 which is a cleaning member and a casing 82 surrounding it. The roller 81 is located near the photosensitive drum 1 with a small space therebetween. The casing 82 is spaced from the roller 81.

In FIG. 1, a numeral 4 indicates image exposure from an optical system (not shown), and numerals 7 indicates guide roller pairs for a transference sheet of paper S.

A bias power source 50 is electrically connected to the developing sleeve 51 of the developing device 5 for applying a bias voltage thereto when the printer is operating. As shown in FIG. 2, a bias voltage applying device 9 is connected to the cleaning roller 81 and the casing 82.

This device 9 includes a power source 91 for attracting the toner and a power source 92 for returning the toner, both of which are connected to the cleaning roller 81 through a power source switcher 95, and also includes a power source 93 for attracting the toner and a power source 94 for returning the toner, both of which are connected to the casing 82 through a power source switcher 96, as well as a controller 97 which controls and switches the switchers 95 and 96.

According to the printer described above, a surface of the photosensitive drum 1 rotating in the clockwise direction in the Figure is charged by the charger 3 to have a uniform potential, and subsequently, the optical system (not shown) performs the image exposure 4 on the charged portions to form an electrostatic latent image. The electrostatic latent image thus formed is developed by the developing device 5 into a visible image. The visible image is transferred by the transfer charger 6 onto a paper sheet S which is supplied from a paper sheet supply mechanism (not shown), and is fixed by a fixing device (not shown).

After the transfer, the toner remaining of the photosensitive drum 1 reaches the cleaning device 8. In the cleaning device 8, the cleaning roller 81 is connected to the power source 91 provided for attracting the toner and the casing 82 is connected to the power source 93 provided for attracting the toner by the instruction of the controller 97 in the voltage applying device 9 when the image forming is performed. Therefore, the residual toner which has reached the cleaning device 8 is first electrically attracted onto the cleaning roller 81, and then is attracted and held by the casing 82. Thus, the residual toner neither falls nor disperses to the circumference. Since the residual toner is held by the roller 81 and the casing 82, appropriate charging and exposing can be performed without an influence by the residual toner during the image forming. The residual charges on the drum 1 are erased by the eraser 2.

When the image is not formed, i.e., during the interruption of the image forming, the cleaning roller 81 in the cleaning device 8 is connected to the power source 92 provided for returning the toner and the casing 82 is connected to the power source 94 provided for returning the toner by the instruction of the controller 97 in the voltage applying device 9.

Thereby, the toner t which has been attracted and held by the casing 82 during the image forming is moved onto the cleaning roller 81 by a potential difference between the casing 82 and the cleaning roller 81, and is further moved therefrom to stick to the photosensitive drum 1. The toner t is moved to the developing device 5 in accordance with the rotation of the drum, and is collected in the developing device 5 for the reuse.

Figure 3:
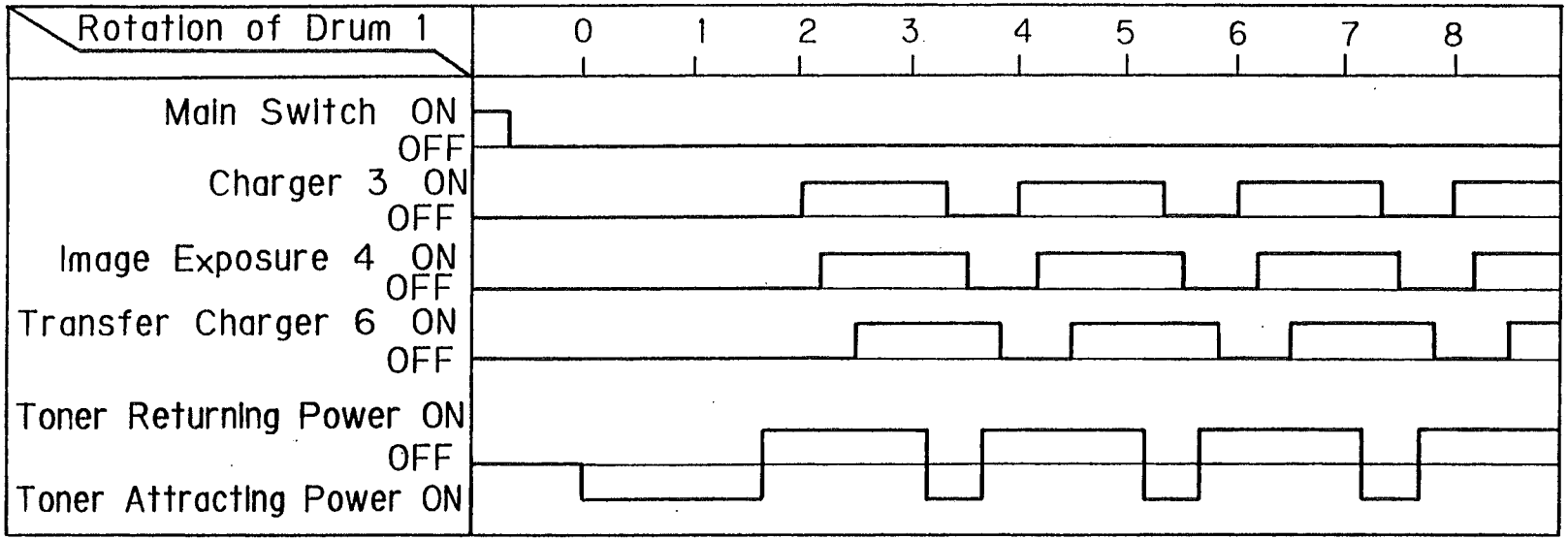
FIG. 3 is a timing chart for illustrating operations of respective parts of a printer in FIG. 1.

FIG. 3 illustrates an example of ON and OFF timings of respective parts during the operation of the printer. In FIG. 3, a term "Main Switch" indicates a main switch of the printer, "Toner Returning Power" indicates the power sources 92 and 94 in FIG. 2, and "Toner Attracting Power" indicates the power sources 91 and 93 in FIG. 2.

As already described, the bias voltage is also applied to the developing sleeve 51 of the developing device 5 by the power source 50. In this example, this bias voltage is selected so that the toner t on the developing sleeve may move toward the electrostatic latent image during the image forming and the toner t stuck to the photosensitive drum 1 may move toward the developing sleeve during the interruption of the image forming.

The bias voltage applied to the developing sleeve may be varied in accordance with the image forming operation and the interruption thereof, so that the toner on the photosensitive drum 1 may be more reliably captured during the interruption of the image forming.

In the embodiment described above, a polarity of the toner and a polarity of the bias voltage applied to the cleaning roller 81 and casing 82 have following relationship during the image forming operation and the interruption thereof.

In the following relationship, the cleaning roller 81 and the casing 82 receive the bias voltages of the same polarities during the image forming and the interruption thereof, respectively. The bias voltage applied to the cleaning roller 81 is set smaller than that applied to the casing 82.

| | | |
|---|---|---|
| Toner Polarity | + | − |
| Toner Attracting Bias Polarity During Image Forming | − | + |
| Toner Returning Bias Polarity During Interruption | + | − |

Each bias may be formed by superimposing an alternating current on a direct current, if necessary, for increasing a toner attracting efficiency.

The present invention is not restricted to the embodiment described hereinbefore, and may be embodied in various forms.

For example, with respect to the cleaning member, the above cleaning roller 81 may be replaced by a magnetic brush roller, fur brush, rubber roller or others, and also may be of either a contact type or a non-contact type.

Further, in the embodiment described above, the toner t attracted on the cleaning roller 81 is further attracted and held by the casing 82, so that the cleaning device 8 can surely and temporarily attract and hold the residual toner as much as possible during the image forming. However, the casing 82 may not be necessary if the residual toner can be temporarily and sufficiently held only by the cleaning roller 81.

Then, another embodiment of the invention will be described with reference to FIGS. 4–7.

Figure 4:
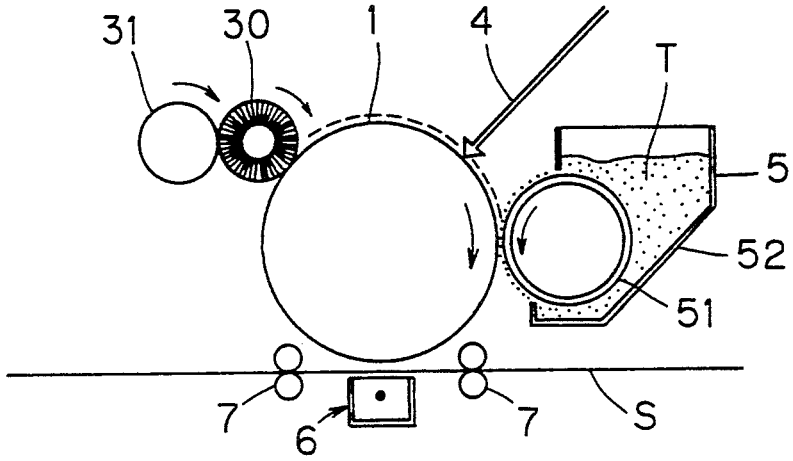
FIG. 4 is a schematic view of another printer according to the invention.

FIG. 4 illustrates a schematic construction of a printer of another embodiment.

The printer is provided with a photosensitive drum 1 which is driven to rotate in the clockwise direction in the Figure, and is also provided around the drum with the developing device 5, the charging member of a rotary contact type, i.e., an electrically conductive fur brush 30, and the transfer charger 6. The fur brush 30 has a volume resistance of $10^2$–$10^6\Omega$cm, and is driven to rotate in the clockwise direction in the Figure while contacting the surface of the photosensitive drum 1. A collecting member or a collecting roller 31 is in contact with this fur brush 30, and this roller is also driven to rotate in the clockwise direction in the Figure. In the Figure, numerals "7" indicate the guide roller pairs for the sheet of paper S.

The developing device 5 is provided with the developing sleeve 51 which is driven to rotate in the counterclockwise direction in the Figure. The sleeve moves positively chargeable toner T accommodated in a casing 52 to the developing region as a uniform toner layer adjusted to have a sticking rate of 0.6 mg/cm$^2$ and a charging rate of 20 $\mu$c/g.

Figure 5:
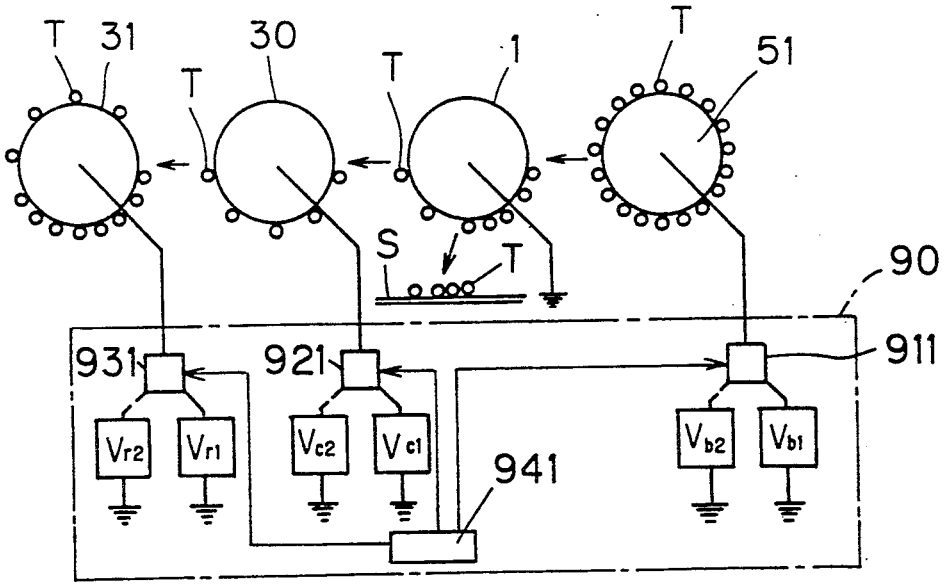
FIG. 5 is a view illustrating conditions in which a voltage applying device applies voltages to respective parts and residual toner moves, in a printer in FIG. 4.

The developing sleeve 51, fur brush 30 and collecting roller 31 are connected to a voltage applying device 90 as shown in FIG. 5. This device 90 includes power sources $Vb_1$ (−200 V) and $Vb_2$ (−400 V) connected to the developing sleeve 51 through a power source switcher 911, power sources $Vc_1$ (−1 KV) and $Vc_2$ (+500 V) connected to the fur brush 30 through the power source switcher 921, power sources $Vr_1$ (−1.5 KV) and $Vr_2$ (+900 V) connected to the collecting roller 31 through the power source switcher 931, and a controller 941 for controlling the switching operations of the power source switchers 911, 921 and 931.

When the image forming is performed in the printer described above, as shown in FIG. 5, the controller 941 in the voltage applying device 90 operates to connect the developing sleeve 51, fur brush 30 and collecting roller 31 to the power sources $Vb_1$, $Vc_1$ and $Vr_1$, respectively.

While the bias voltages are being applied to the respective parts, the photosensitive drum 1, fur brush 30 and collecting roller 31 are driven to rotate in the clockwise direction in the Figure, respectively, and the developing sleeve 51 is driven to rotate in the counterclockwise direction.

The photosensitive drum 1 is charged to have a uniform surface potential $V_o$ of about −600 V by the fur brush 31 to which the voltage $Vc_1$ of −1 KV is applied. The image exposure 4 is performed by the optical system (not shown) on the charged surface of the photosensitive drum 1, and the potentials at the exposed portions decrease in accordance with quantities of light, so that the electrostatic latent image is formed.

This electrostatic latent image is developed with the toner T on the developing sleeve 51, to which the developing bias voltage $Vb_1$ of −200 V is applied, into the visible image. This visible image is transferred by the transfer charger 6 onto the transfer sheet S supplied from the transfer sheet supplying device (not shown), and is fixed thereon by the fixing device (not shown).

After the transfer, the residual toner, which remains on the photosensitive drum 1 and reaches the fur brush 30 in accordance with the rotation of the drum 1, is scraped off by the fur brush 30 from the surface of the drum 1 and is electrically attracted to the brush. Simultaneously and continuously, the brush 30 charges the surface of the drum 1 to the uniform surface potential $V_o$ of about −600 V. The residual toner T attracted to the fur brush 30 is electrically attracted onto the collecting roller 31, to which the collecting bias voltage $Vr_1$ of −1.5 KV has been applied, and is held thereon. The image forming is performed in this manner, and after the transfer, the toner T remaining on the photosensitive drum 1 is moved through the fur brush 30 and is held on the collecting roller 31 without falling and dispersing to the circumference. Since the residual toner T is held on the roller 31, the appropriate charging and exposing can be performed without an influence by the residual toner during the image forming.

Figure 6:
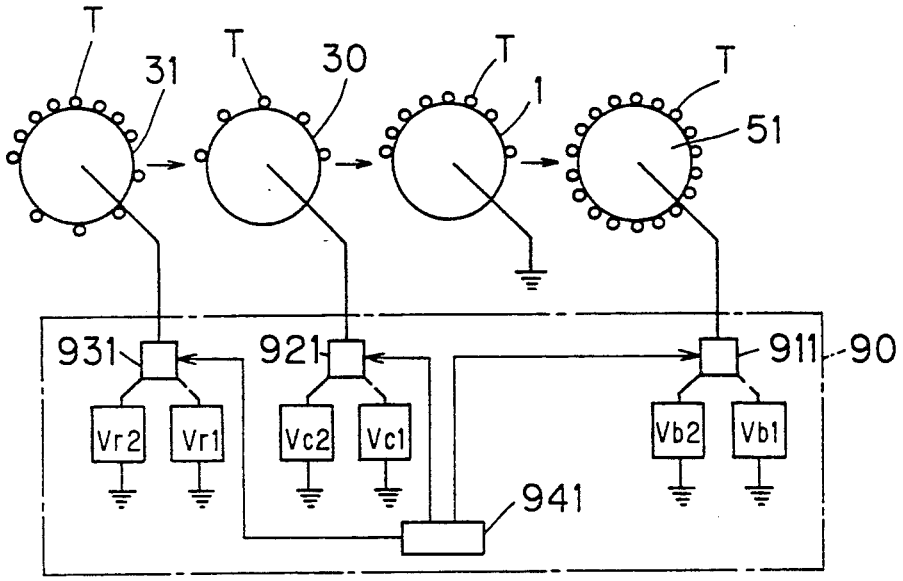
FIG. 6 is a view similar to FIG. 5, but when image formation is not carried out.

Operations during the interruption of the image forming will be described below. During the interruption, as shown in FIG. 6, the controller 941 in the voltage applying device 90 controls the respective power source switchers so that the developing sleeve 51, fur brush 30 and the collecting roller 31 are connected to the power sources $Vb_2$, $Vc_2$ and $Vr_2$, respectively.

Owing to a fact that the bias voltage $Vr_2$ of +900 V is applied to the collecting roller 31 and the voltage $Vc_2$ of +500 V is applied to the fur brush 30, the developer which has been held on the collecting roller 31 is scraped off by the fur brush 30 from the collecting roller 31 to the brush 31 and then sticks onto the photosensitive drum 1. The toner T stuck onto the photosensitive drum 1 moves to the developing sleeve 51 to which the bias voltage $Vb_2$ of −400 V has been applied, and is collected into the developing device 5.

Figure 7:
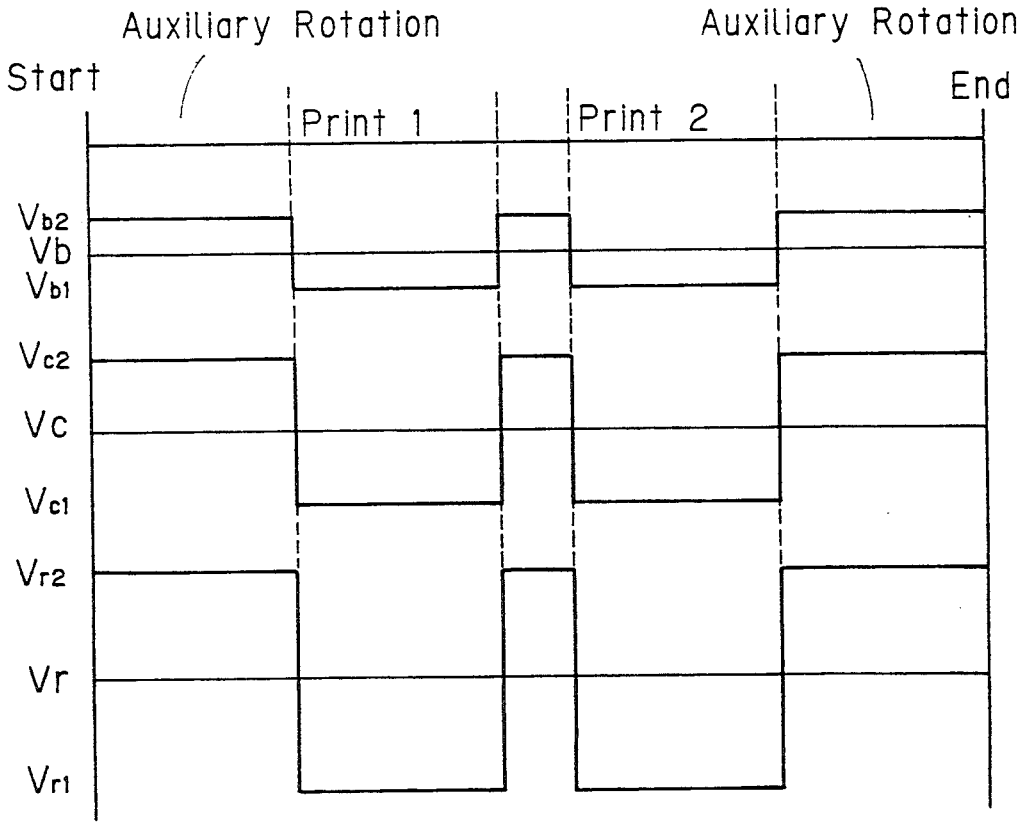
FIG. 7 is a timing chart for illustrating switching of bias voltages based on an instruction of a controller in a voltage applying device.

FIG. 7 shows switching timings of the respective biases determined by the controller 941 for performing continuous printing of two sheets.

As can be seen from this timing chart, for periods of time immediately after switch-on of the printer, during auxiliary rotation of various parts performed prior to switch-off of the printer, and between printing operations, the power sources $Vb_2$, $Vc_2$ and $Vr_2$ are actually used, and the during the image forming, the power sources $Vb_1$, $Vc_1$ and $Vr_1$ are actually used.

According to the printer described above, neither the conventional cleaning device nor the container for temporarily collecting the removed developer are required for removing the residual toner T from the photosensitive drum 1, so that the sizes and cost of the printer can be actually reduced. The residual toner T on the photosensitive drum 1 is temporarily held by the collecting roller only when the image forming is carried out, and will be returned to the developing device 5 when the image forming is interrupted, so that the residual toner T will not be excessively collected on the collecting roller 31 and thus will not overflow therefrom, and the residual toner T can be collected to the developing device 5 for the reuse.

In the above description, the interruption of the image forming mainly indicates the condition in which the visible image has been transferred to the sheet, and the residual toner on the photosensitive drum has been collected and held by the casing 82 of the cleaning device 81 (see FIG. 1) or the collecting roller 31 of the charging device (see FIG. 4).

The operation for returning the collected residual toner to the photosensitive drum or member can be performed each time the copying of one sheet is completed, or may be performed after the completion of the copying of several sheets, of which number is set prior to the actual copying operation. It may also be performed after each completion of the copying of the predetermined number of sheets.

What is claimed is:

1. An image forming apparatus comprising:

a rotatable photoreceptor;

means for forming an electrostatic latent image on a surface of said photoreceptor;

a developing device for developing with toner said electrostatic latent image on said photoreceptor surface to form a visible image;

means for transferring said visible image onto a recording medium;

means for collecting residual toner remaining on said photoreceptor surface after the transfer, wherein said collecting means includes a charging member for charging said photoreceptor surface during the image forming;

means for applying a bias voltage to said collecting means; and means for controlling said bias voltage applying means so that said residual toner is collected and held by said collecting means when image forming is carried out and that said residual toner held by said collecting means is returned to said developing device through said photoreceptor when the image forming is not carried out.

2. An image forming apparatus comprising:

a rotatable photoreceptor;

means for charging a surface of said photoreceptor, wherein said charging means includes a charging member and a collecting member adjacent to each other;

means for exposing said charging surface of said photoreceptor to form an electrostatic latent image on said photoreceptor surface;

a developing device for developing with toner said electrostatic latent image on said photoreceptor surface to form a visible image;

means for transferring said visible image onto a recording medium;

means for applying a bias voltage to said charging means; and means for controlling said bias voltage applying means so as to apply said bias voltage having a polarity opposite to that of said toner when image forming is carried out and to apply said bias voltage having the same polarity as said toner when the image forming is not carried out; wherein said bias voltage applied to said collecting member is larger than that applied to said charging member, so that said residual toner on said photoreceptor surface is removed to said charging member and held by said collecting member when the image forming is carried out, and that said residual toner held by said collecting member is returned to said developing device through said charging member and said photoreceptor.

3. An image forming apparatus comprising:

a rotatable photoreceptor;

means for charging a surface of said photoreceptor;

means for exposing said charged surface of said photoreceptor to form an electrostatic latent image on said photoreceptor surface;

developing device for developing with toner said electrostatic latent image on said photoreceptor surface to form a visible image;

means for transferring said visible image onto a recording medium;

means for applying a bias voltage to said charging means; and means for controlling said bias voltage applying means so as to apply said bias voltage having a polarity opposite to that of said toner when image forming is carried out and to apply said bias voltage having the same polarity as said toner when the image forming is not carried out, wherein said developing device is provided with a developing roller to which a bias voltage having a polarity opposite to that of said toner is applied, and said bias voltage applied to said developing roller during interruption of the image forming is larger than that applied to said developing roller during the image forming.

4. An image forming method comprising the steps of:

charging a surface of a photoreceptor by a charging member;

exposing said charged surface of said photoreceptor to form an electrostatic latent image thereon;

developing said electrostatic latent image with toner supplied from a developing device to form a visible image;

transferring said visible image on a recording medium;

collecting residual toner on said surface of said photoreceptor by means of said charging member;

holding said collected residual toner by said charging member; and returning said residual toner held by said charging member to said developing device through said photoreceptor when image forming is not carried out.

5. An image forming apparatus comprising:

a rotatable photoreceptor;

means for charging the surface of the photoreceptor, said charging means having a contacting member being in contact with the surface of the photoreceptor to apply charging voltage thereon;

means for exposing the charged surface of the photoreceptor to form an electrostatic latent image on the photoreceptor surface;

developing means for developing with toner the electrostatic latent image on the photoreceptor surface to form a visible image;

means for transferring the visible image onto a recording medium;

means for holding the residual toner adhering to the contacting member, said holding means adjacent to the charging means; and means for controlling the charging means and the holding means so that the residual toner adhered to the contacting member is transported from the charging means to the holding means in order to hold the residual toner by the holding means when image forming is carried out and that the collected toner held by the holding means is returned to the photoreceptor surface through the contacting member when the image forming is not carried out.

6. An image forming apparatus comprising:

a rotatable photoreceptor;

means for forming an electrostatic latent image on the surface of the photoreceptor;

developing means for developing with toner the electrostatic latent image on the photoreceptor surface to form a visible image;

means for transferring the visible image onto a recording medium;

means for collecting residual toner remaining on the photoreceptor surface after transfer;

means for holding the residual toner collected by the collecting means; and means for controlling the collecting means and the holding means so that the residual toner is collected by the collecting means and then the collected residual toner is transported from the collecting means to the holding means in order to hold the collected residual toner by the holding means when image forming is carried out and that the collected toner held by the holding means is returned to the photoreceptor surface through the collecting means when the image forming is not carried out.

* * * * *